US008011064B2

(12) United States Patent
Leimkuehler et al.

(10) Patent No.: US 8,011,064 B2
(45) Date of Patent: Sep. 6, 2011

(54) REFRIGERATOR HINGE COVER

(75) Inventors: Scott William Leimkuehler, Swisher, IA (US); Christopher Ryan McElvain, Homestead, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 372 days.

(21) Appl. No.: 12/277,561

(22) Filed: Nov. 25, 2008

(65) Prior Publication Data

US 2010/0125970 A1 May 27, 2010

(51) Int. Cl.
*E05D 11/10* (2006.01)

(52) U.S. Cl. ..... 16/251; 16/388

(58) Field of Classification Search ..... 16/250, 16/251, 387, 380, 388; 49/397, 399, 381, 49/388; 312/329, 326, 405, 401
See application file for complete search history.

(56) References Cited

U.S. PATENT DOCUMENTS

| | | | | |
|---|---|---|---|---|
| 1,520,765 | A | 12/1924 | Norton | |
| 2,047,909 | A * | 7/1936 | North | 16/250 |
| 2,585,836 | A * | 2/1952 | Quigley | 16/250 |
| 3,496,594 | A | 2/1970 | Arthur | |
| 3,576,046 | A | 4/1971 | Czapar | |
| 3,675,271 | A * | 7/1972 | Fellwock et al. | 16/265 |
| 4,228,561 | A | 10/1980 | Gwozdz | |
| 4,319,382 | A | 3/1982 | Zernig | |
| 4,550,576 | A | 11/1985 | Tate, Jr. et al. | |
| 4,570,291 | A * | 2/1986 | Smith et al. | 16/250 |
| 4,825,508 | A * | 5/1989 | Post, Jr. | 16/250 |
| 4,958,877 | A * | 9/1990 | Lezotte et al. | 296/65.17 |
| 5,187,837 | A | 2/1993 | Gunderson et al. | |
| 5,272,789 | A * | 12/1993 | Mitchell et al. | 16/291 |
| 5,292,171 | A * | 3/1994 | Harrell | 297/113 |
| 5,362,131 | A * | 11/1994 | Susko et al. | 297/463.1 |
| 6,036,294 | A | 3/2000 | Banicevic et al. | |
| 6,152,554 | A * | 11/2000 | Parisi | 312/405 |
| 6,637,073 | B2 | 10/2003 | Kincaid | |
| 7,188,390 | B2 | 3/2007 | Cheng | |
| 7,305,797 | B2 | 12/2007 | Chiang | |
| 2002/0078526 | A1 * | 6/2002 | Kincaid | 16/250 |

FOREIGN PATENT DOCUMENTS

| | | | |
|---|---|---|---|
| DE | 19600553 | C1 * | 6/1997 |
| JP | 11083293 | A * | 3/1999 |
| JP | 11141217 | A | 5/1999 |
| JP | 2003176659 | A | 6/2003 |
| JP | 2006328689 | A | 12/2006 |
| JP | 2007138658 | A | 6/2007 |

* cited by examiner

*Primary Examiner* — Chuck Y. Mah
(74) *Attorney, Agent, or Firm* — John M. Morrison; McKee, Vorhees & Sease PLC

(57) ABSTRACT

A hinge cover is provided for a refrigerator door hinge so as to hide the hinge screws. The cover includes a cap with a front face and a side wall extending continuously around the cover. A bead is formed on the inside of the side wall to engage a mounting plate secured to the base of the door hinge, or alternatively, to frictionally engage the hinge base. The cover is made of a flexible material, and includes a slot through which the hinge flange and post extend. The cover can be colored to match or complement the refrigerator color.

18 Claims, 5 Drawing Sheets

REFRIGERATOR HINGE COVER

BACKGROUND OF THE INVENTION

Refrigerators typically have one or two doors which are mounted to the refrigerator cabinet by hinges so as to pivot between open and closed positions for the fresh food compartment and/or freezer compartment. The hinges are mounted to the cabinet with screws which normally are visible, particularly for the hinges which are located near eye level. The screws generally do not match the color of the cabinet or doors. Prior art efforts to hide the screws include caps press fit over the head of the screws. Other prior art hinges screw caps are complex, difficult to install, and/or expensive to manufacture.

Therefore, a primary objective of the present invention is the provision of an improved cover for a refrigerator door hinge to hide the hinge screws.

Another objective of the present invention is the provision of a refrigerator door hinge cover having an aesthetically pleasing appearance.

A further objective of the present invention is the provision of a refrigerator hinge cover which is quick and easy to install.

Still another objective of the present invention is the provision of a hinge cover for a refrigerator door which is resilient so as to mount over the hinge post.

Another objective of the present invention is the provision of a cover for a refrigerator door hinge which can be made in different colors to match or complement the color of the refrigerator.

Yet another objective of the present invention is the provision of a hinge cover for a refrigerator door hinge which is economical to manufacture and durable in use.

BRIEF SUMMARY OF THE INVENTION

A cover is provided for a refrigerator door hinge to hide the hinge screws so as to improve the aesthetics of the refrigerator, particularly when the door is opened. The cover is a one-piece cap which is frictionally mounted onto the hinge. The cap is resilient or flexible, and includes a slot to fit over the hinge post and hinge flange. In one embodiment, a flat plate is mounted to the hinge onto which the cover overlappingly fits. In another embodiment, the cover is mounted directly to the hinge base with a friction fit.

The invention also is directed towards a method of hiding the refrigerator door hinge screws. In this method, the hinge base is secured to the refrigerator cabinet using screws, and then a one-piece rubber cover is mounted over the base so as to hide the screws behind the cover.

DETAILED DESCRIPTION OF THE PREFERRED EMBODIMENT

Figure 1:
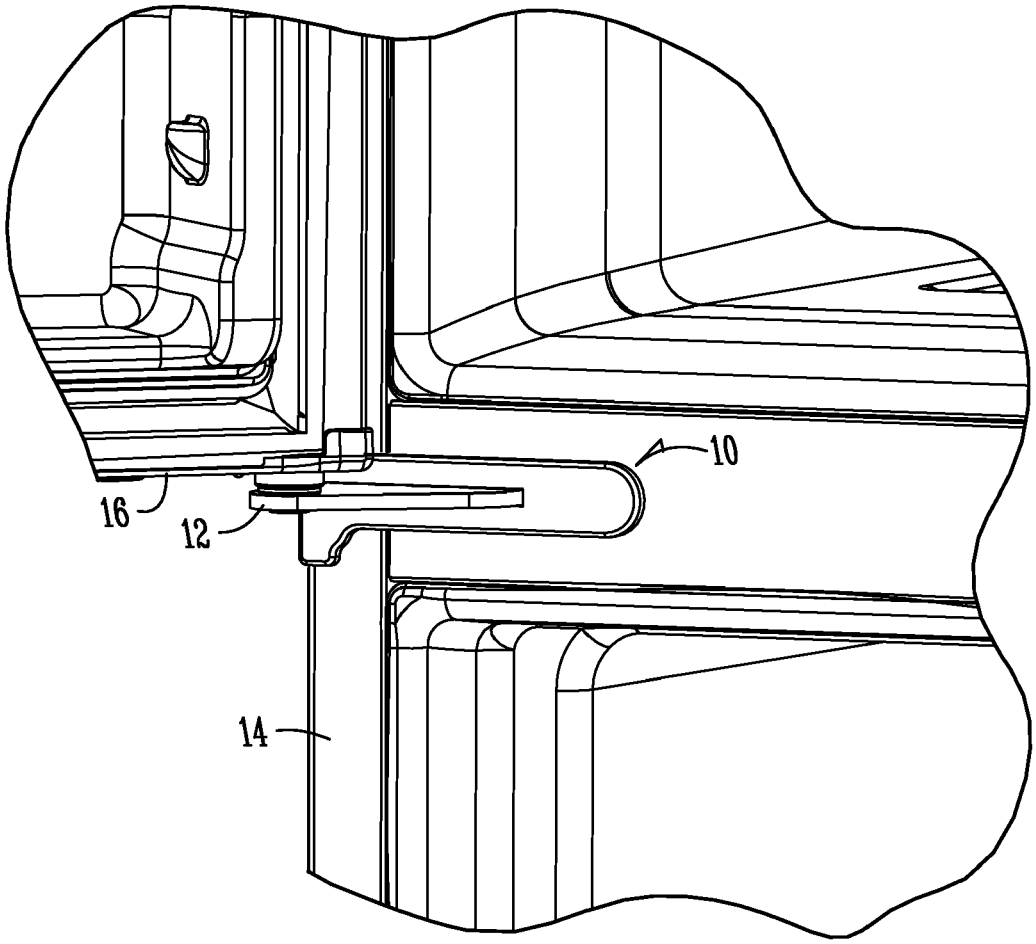
FIG. 1 is a perspective view of a refrigerator having a door mounted on a hinge, and showing the hinge cover of the present invention assembled onto the refrigerator hinge.

In the drawings, the hinge cover of the present invention is generally designated by the reference numeral 10. As seen in FIG. 1, the hinge cover 10 is used on a refrigerator door hinge 12 which is mounted to a refrigerator cabinet 14 to pivotally mount a door 16 to the cabinet 14. The hinge 12 is conventional and generally includes a base 18 with a flange 20 extending forwardly from the base. A hinge post 22 extends upwardly from the flange 20 and into a bottom corner of the door 16 to define a pivot axis for the door. Screws 24 secure the base 18 of the hinge 12 to the cabinet 14.

Figure 2:
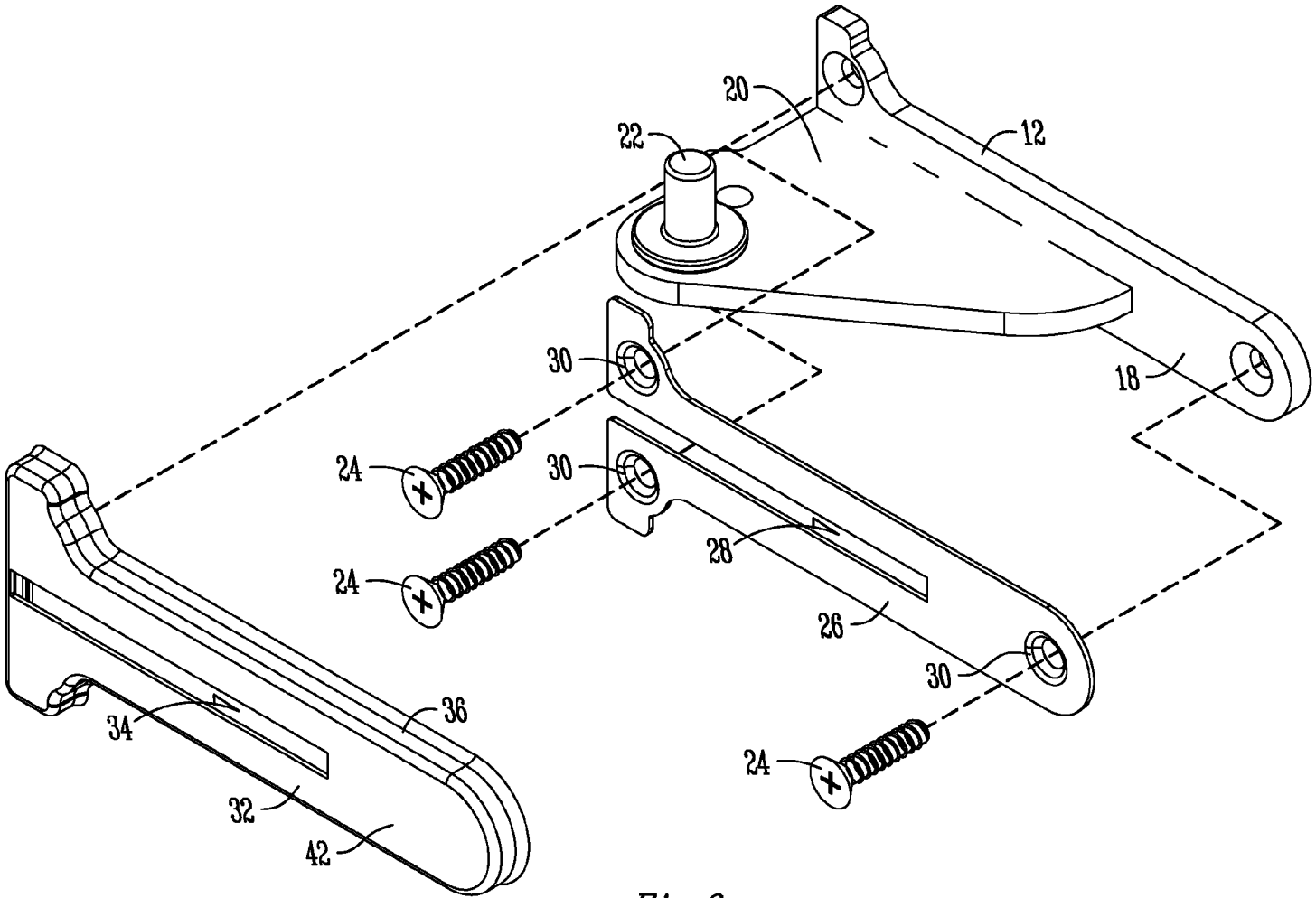
FIG. 2 is an exploded view of the refrigerator hinge with a first embodiment of the hinge cover of the present invention.
Figure 5:
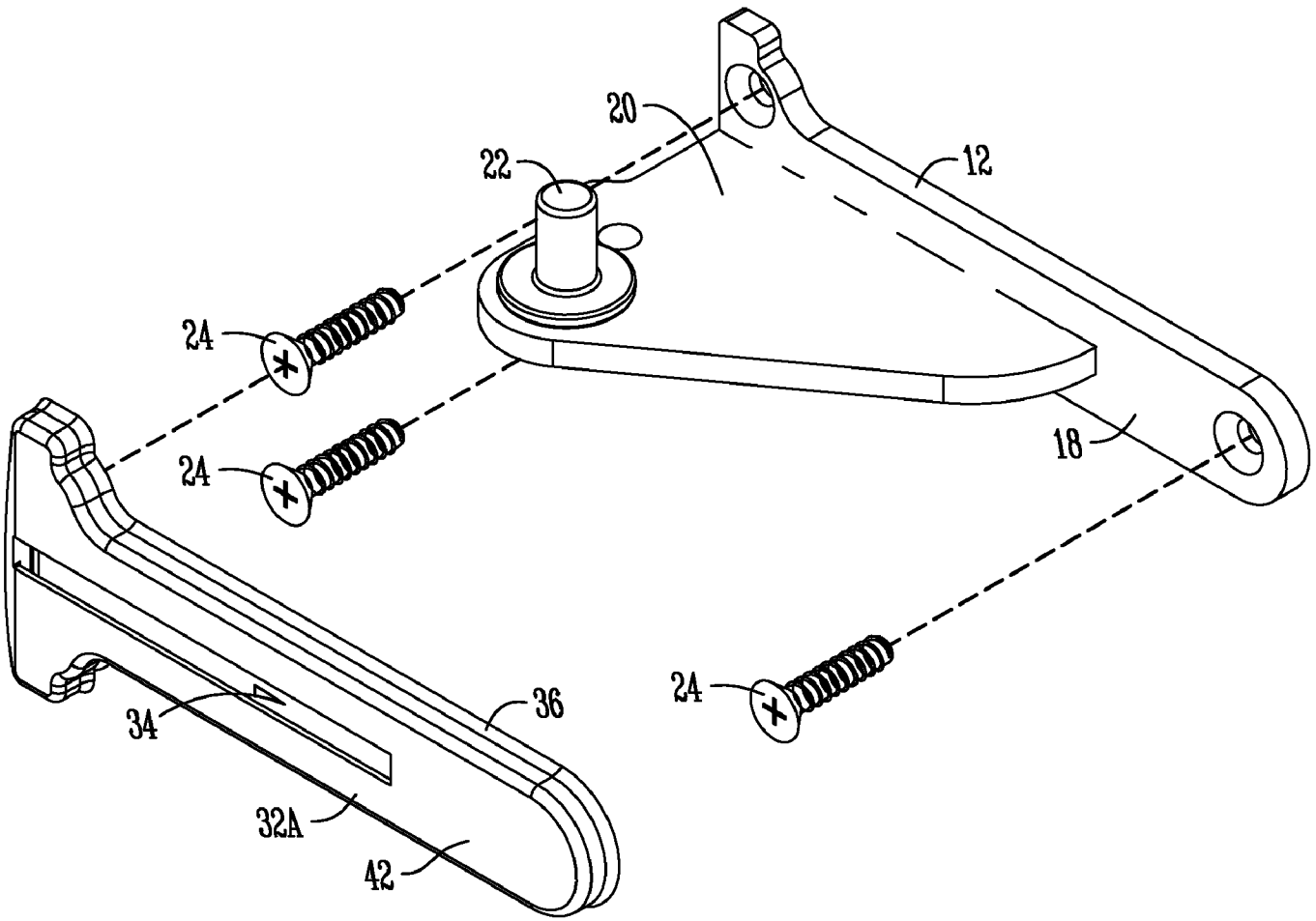
FIG. 5 is an exploded view of the refrigerator hinge with a second embodiment of the hinge cover.
Figure 6:
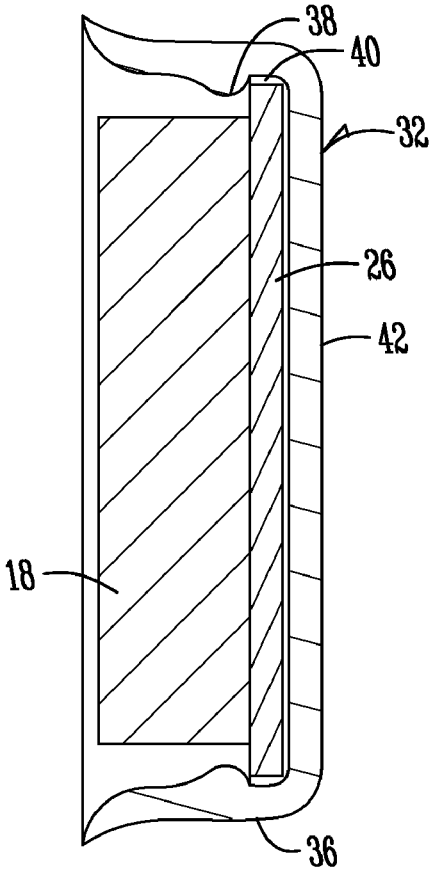
FIG. 6 is a sectional view of the first embodiment cover mounted on the door hinge, as taken along lines 6-6 of FIG. 3.

The invention includes two embodiments of the hinge cover 10, shown in FIGS. 2 and 5, respectively. In the first embodiment, a plate 26 is provided to overlie the base 18. The plate includes a slot 28 through which the flange 20 extends and holes 30 for the mounting screws 24. The plate 26 has a perimeter edge which extends slightly beyond the perimeter of the hinge base 18, as seen in FIG. 6.

The cover 10 of the first embodiment is a resilient cap 32 made of rubber or other flexible material. The cap 32 includes a slot 34 through which the flange 20 extends. The cap 32 includes a sidewall 36 which extends continuously 360° so that the slot 34 is fully enclosed, rather than being open at the outer end, as is the slot 34 of the plate 26. The continuous sidewall 36 facilitates mounting of the cap 32. As seen in FIG. 6, a small bead or lip 38 is provided on the interior surface of the sidewall 36 so as to define a groove 40 on the inside of the front face 42 of the cap 32.

Figure 3:
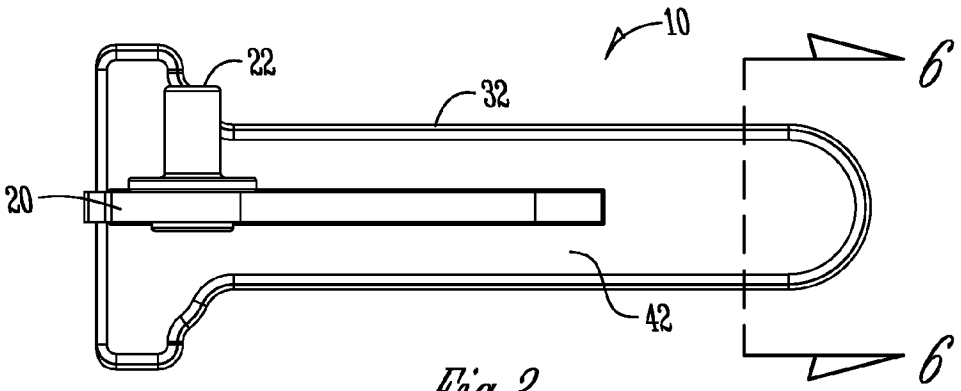
FIG. 3 is a front elevation view of the hinge cover mounted on the hinge.
Figure 4:
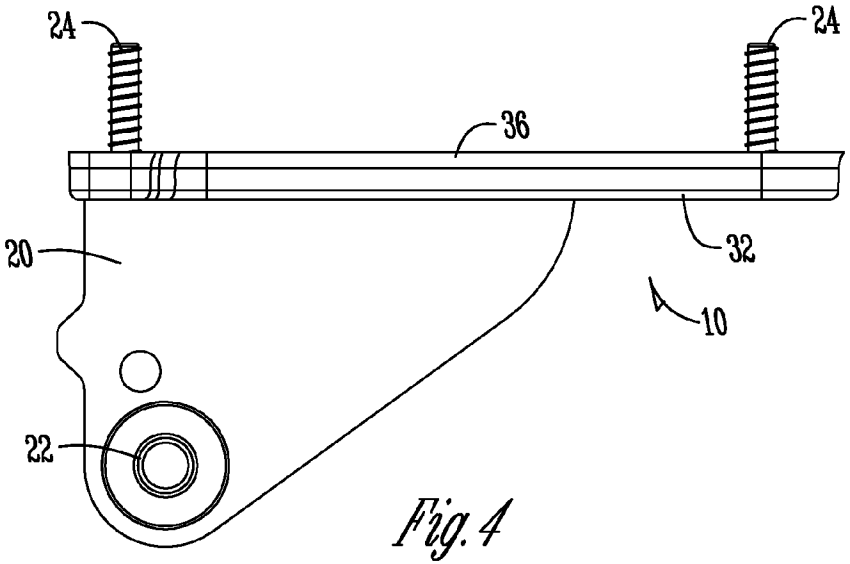
FIG. 4 is a top plan view of the hinge cover mounted on the hinge.

In use, the slot 34 of the cap 32 is stretched over the hinge post 22. The cap 32 is then pressed over the plate 26 so that the edge of the plate 26 is received in the groove 40, with the bead 38 retaining the cap 32 in position on the plate 26, in covering relation to the base 18 and screws 24 of the hinge 12, as seen in FIGS. 1, 3 and 4. Thus, the hinge screws 24 are hidden from view by the cover 10.

Figure 7:
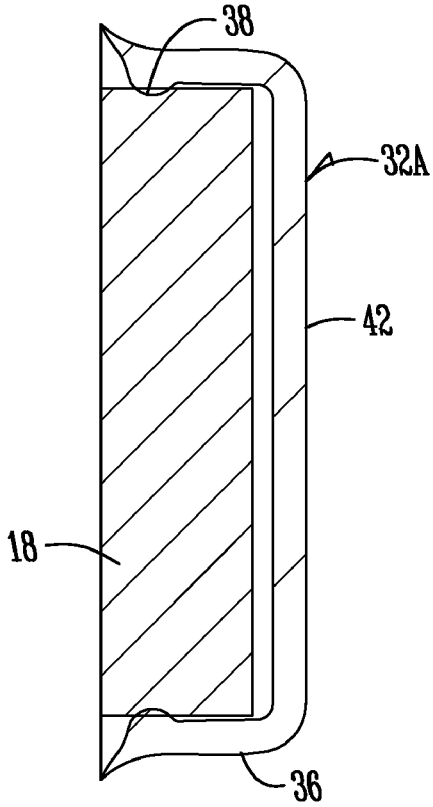
FIG. 7 is a sectional view similar to FIG. 6, but showing the second embodiment of the hinge cover.

In a second embodiment, the plate 26 is eliminated, and the cover 10 includes a cap 32A having the same external configuration as the cap 32. The bead 38 is formed near the perimeter edge of the sidewall 36, as seen in FIG. 7, so as to frictionally engage the hinge base 18 when the cap 32A is mounted over the post 22 and flange 20, so as to hide the screws 24 behind the cap 32A.

The caps 32, 32A can be quickly and easily installed onto the hinge 12 before the door 16 is mounted on the post 22. The installation of the cover 10 requires no tools. If it becomes necessary to remove the refrigerator door 16, the cap 32, 32A can be easily removed from the plate 26 or hinge base 18, thereby providing access to the screws 24.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved hinge assembly for a refrigerator having a cabinet and a door pivotally mounted to the cabinet for movement between open and closed positions, comprising:

a hinge base secured to the cabinet with fasteners;

a protrusion integrally formed with the hinge base and extending forwardly from the hinge base;

a hinge pin mounted to the protrusion and extending into the door to define a vertical pivot axis; and a cover overlying the hinge base to cover the fasteners and having a slot through which the protrusion extends.

2. The hinge assembly of claim 1 wherein the cover includes a front face and a perimeter edge.

3. The hinge assembly of claim 2 wherein the slot resides in the front face.

4. The hinge assembly of claim 2 wherein the perimeter edge is continuous.

5. The hinge assembly of claim 1 wherein the cover matingly engages the hinge base.

6. The hinge assembly of claim 1 wherein the cover is elastic.

7. The hinge assembly of claim 1 wherein the cover is stretchable.

8. The hinge assembly of claim 1 wherein the cover is rubber.

9. The hinge assembly of claim 1 further comprising a plate secured over the hinge base by the fasteners, and the cover having a lip extending over a perimeter edge of the plate.

10. A hinge cover for a refrigerator door hinge having a base mounted to the refrigerator with screws and a forwardly projecting flange to support a vertical pivot pin, the hinge cover comprising:

a plate secured to the base with the hinge screws;

a one piece cap fit over the flange in covering relation with the hinge base and the plate to hide the screws;

wherein the plate has a perimeter edge extending beyond the perimeter edge of the base, with the cap being stretch fit over the perimeter edge of the plate.

11. The hinge cover of claim 10 wherein the cap includes a slot through which the flange extends.

12. The hinge cover of claim 10 wherein the cap includes a front face and a perimeter edge.

13. The hinge cover of claim 12 wherein the perimeter edge extends 360° around the cap.

14. The hinge cover of claim 10 wherein the cap is resilient so as to stretch over the pivot pin.

15. The hinge cover of claim 10 wherein the plate substantially matches the shape of the base.

16. A method of hiding hinge screws for a hinge pivotally mounting a refrigerator door to a refrigerator cabinet, comprising:

securing a hinge base to the refrigerator cabinet using screws;

mounting a plate over the base using the screws; and mounting a one-piece cover over the base; and retentively fitting the cover over a perimeter edge of the plate so as to hide the screws behind the cover.

17. The method of claim 16 wherein the hinge includes a protrusion extending forwardly from the base to support a vertical pivot pin, the method further comprising extending the protrusion through a slot in the cover and stretching the cover over the pivot pin.

18. An improved hinge assembly for a refrigerator having a cabinet and a door pivotally mounted to the cabinet for movement between open and closed positions, comprising:

a hinge base secured to the cabinet with fasteners;

a protrusion integrally formed with the hinge base and extending forwardly from the hinge base;

a hinge pin mounted to the protrusion and extending into the door to define a vertical pivot axis;

a cover overlying the hinge base to cover the fasteners and having a slot through which the protrusion extends; and a plate secured over the hinge base by the fasteners, and the cover having a lip extending over a perimeter edge of the plate.

* * * * *